US005197657A

United States Patent [19]

Cassidy et al.

[11] Patent Number: 5,197,657

[45] Date of Patent: Mar. 30, 1993

[54] WRAPPER FOR A FLANGED TRAY

[75] Inventors: Benjamin J. Cassidy, Waldwick, N.J.; Gerald F. Justice, Washingtonville, N.Y.

[73] Assignee: International Paper Company, Purchase, N.Y.

[21] Appl. No.: 899,058

[22] Filed: Jun. 16, 1992

Related U.S. Application Data

[63] Continuation-in-part of Ser. No. 795,355, Nov. 20, 1991, abandoned.

[51] Int. Cl.[5] ..... B65D 65/12

[52] U.S. Cl. ..... 229/40; 206/564

[58] Field of Search ..... 229/40; 206/485, 564, 206/565, 427, 434

[56] References Cited

U.S. PATENT DOCUMENTS

| | | | |
|---|---|---|---|
| 1,978,296 | 10/1934 | Donovan et al. | 206/44 R |
| 3,167,214 | 1/1965 | Mahon | 229/40 |
| 3,281,051 | 10/1966 | O'Brien et al. . | |
| 3,411,696 | 11/1968 | Ayer et al. | 229/40 |
| 3,604,560 | 9/1971 | Farquhar | 229/40 |
| 3,618,848 | 11/1971 | Pawlowski | 229/40 |
| 3,637,404 | 1/1972 | MacManus | 206/45.32 |
| 3,680,691 | 8/1972 | Lock | 229/40 |
| 3,705,681 | 12/1972 | Rossi et al. | 229/40 |
| 3,963,121 | 6/1976 | Kipp | 229/40 |
| 4,200,188 | 4/1980 | Webinger | 206/485 |
| 4,451,001 | 5/1984 | Webinger | 229/40 |
| 4,674,633 | 6/1987 | Steadman | 206/521 |

FOREIGN PATENT DOCUMENTS

| | | | |
|---|---|---|---|
| 986063 | 3/1976 | Canada | 229/40 |
| 2637257 | 4/1990 | France | 229/40 |
| 157858 | 9/1978 | Netherlands | 229/40 |

*Primary Examiner*—Gary E. Elkins

*Attorney, Agent, or Firm*—Michael J. Doyle; Walt Thomas Zielinski

[57] ABSTRACT

A package including a flanged tray and a wrapper surrounding it. The tray typically contains a foodstuff such as a pie. The wrapper is formed of a rectangular, unitary blank of paperboard which is folded and wrapped aroung the tray, the wrapper being folded to the form of a tube with the tray therein. The wrapper includes two oppositely located latching flaps (24) whose free edges (28) are curved so as to match the curvature of the tray. The curved or arcuate latching flaps are initially folded downwardly more than 90 degrees from the plane of the blank. Other portions (16, 18) of the blank are bent upwardly along respective transverse fold lines (23), causing the arcuate latching flaps to bow inwardly and beneath the flanges of a tray (32) and contact the tray flanges (34). Portions (16, 18) of the wrapper are then folded beneath and on the sides of the tray and ends (17) are overlapped and glued together to finish the package. If the tray is rectangular instead of round or oval, the free edges (28) of the flaps (24) are straight.

12 Claims, 4 Drawing Sheets

FIG. 5
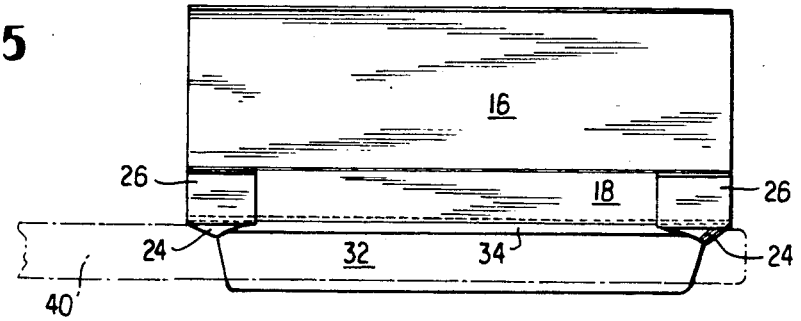
FIG. 6
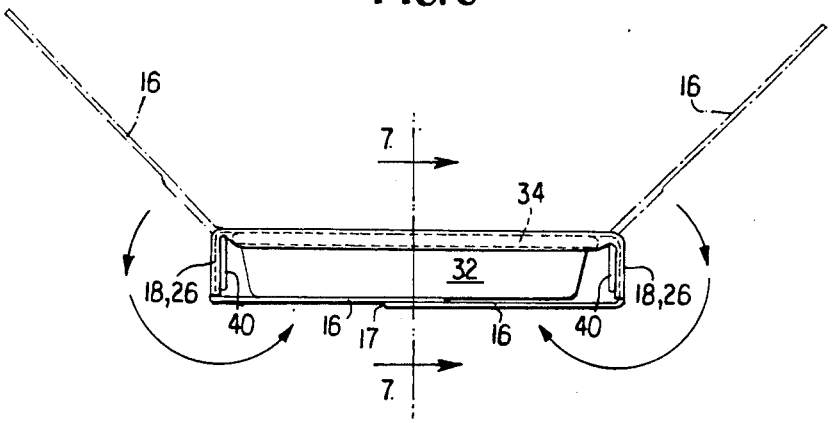
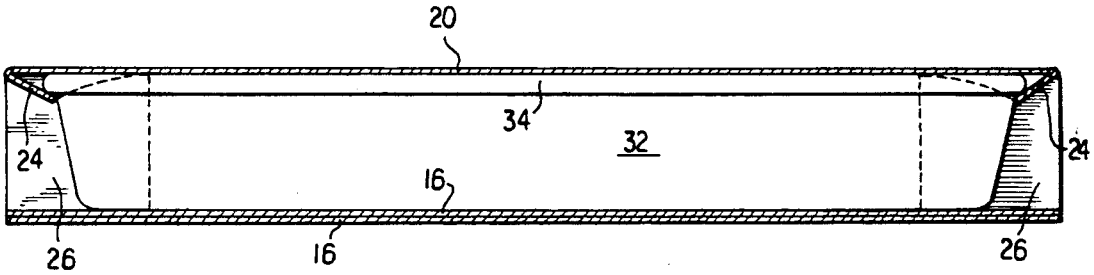
FIG. 7

WRAPPER FOR A FLANGED TRAY

This is a continuation-in-part of copending application(s) Ser. No. 07/795,355 filed on Nov. 20, 1991, abandoned.

BACKGROUND OF THE INVENTION

This invention relates to a wrapper and more particularly for a paperboard wrapper for forming a package having a flanged tray, such as a pie tray.

The art is aware of wrappers for trays, the wrapper being in the general form of a paperboard blank wrapped around a flanged tray, such constructions usually having tabs or flaps to engage either the flange of the tray or the tray itself to inhibit movement of the tray with respect to the wrapper. The resultant package includes a generally rectangular sleeve or tube, open at both ends, with the tray positioned centrally thereof and held in place by flaps, flanges, or gussets.

While satisfactory for the purpose intended, such known flanged tray wrappers suffer the disadvantage of complexity, with their attendant need for cut flaps, panels or gussets.

SUMMARY OF THE INVENTION

According to the practice of this invention, a tube type wrapper for a flanged tray, such as a tray containing a pie or other foodstuff, is formed from a unitary blank of paperboard or other stiff, resilient, and foldable sheet material. The blank is in the general form of a rectangle, with opposite longitudinal edges each provided with a foldable latching or retaining flap. The free edge of each latching flap is configured to match the curvature of the flanged tray. Each latching flap fits underneath the flange of the tray and engages the tray sides to inhibit movement of the tray out of the open ends of the tube type wrapper. The package is made by placing the tray to be packaged underneath the blank, and then folding and glueing the blank in a particular sequence.

The wrapper may enclose a single flanged tray or it may enclose a plurality of flanged trays.

BRIEF DESCRIPTION OF THE DRAWINGS

FIG. 5 is a view taken at 90 degrees with respect to FIG. 4.

FIG. 6 is an end elevational view illustrating the final steps in the formation of the package.

FIG. 7 is a view taken along section 7—7 of FIG. 6 and illustrates the completed package.

DETAILED DESCRIPTION OF THE INVENTION

Figure 1:
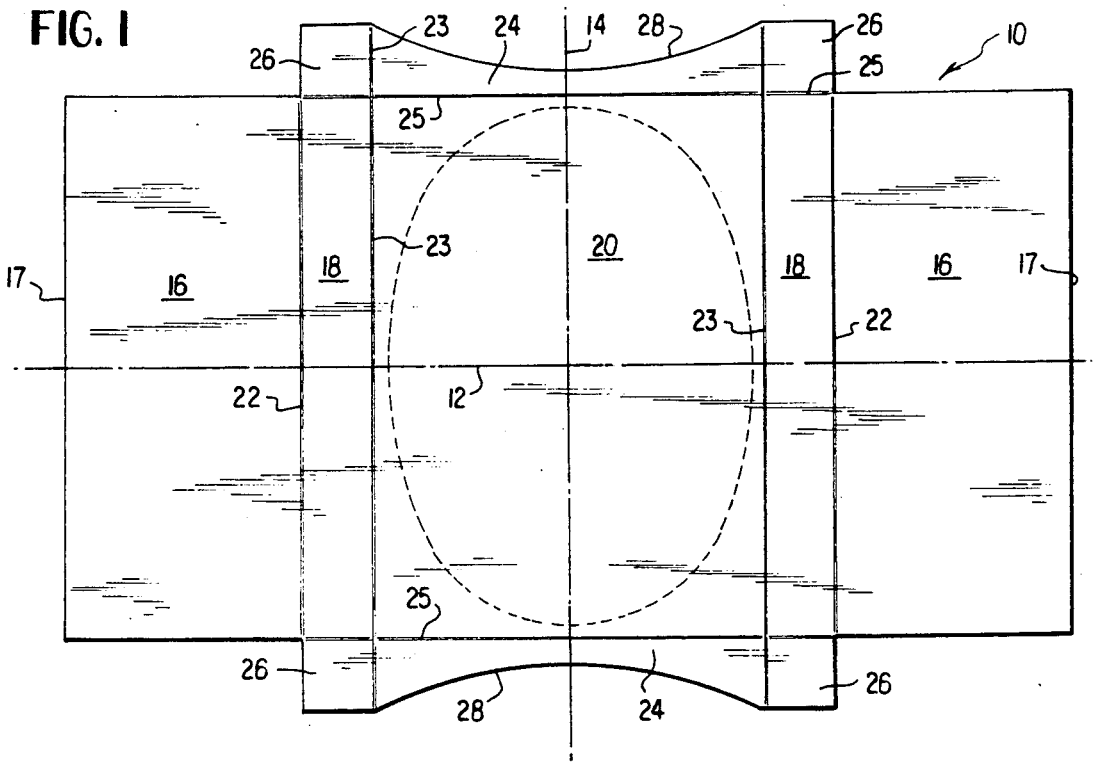
FIG. 1 is a plan view of a unitary blank of paperboard and also illustrates in phantom the outline of an oval flanged tray.

Referring now to FIG. 1 of the drawings, the numeral 10 denotes generally the paperboard blank of this invention, the blank having first and second axes of mirror symmetry denoted, respectively, as 12 and 14. Axis 14 is termed the longitudinal axis of the blank. The dashed oval at FIG. 1 illustrates the outline of an oval flanged tray positioned beneath the blank. The blank includes outermost bottom forming panels 16, side wall forming panels 18, and a central panel 20. Transverse lines 22 join panels 16 and 18, while transverse fold lines 23 join panels 18 and 20. Lines 23 define a first pair of fold lines, while lines 22 define a second pair of transverse fold lines. Opposite longitudinal edges of the blank foldably carry latching flaps 24 and tabs 26, the later elements joined by the ends of the transverse fold lines 23. Each latching flap 24 is arcuate along its free edge 28.

Figure 2:
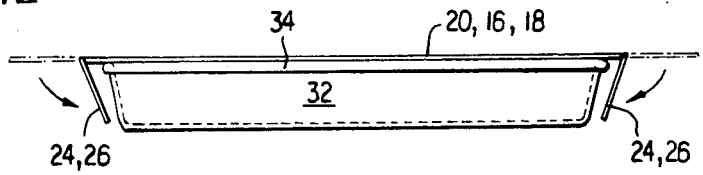
FIG. 2 is a view illustrating a first step in forming the package of this invention.
Figure 3:
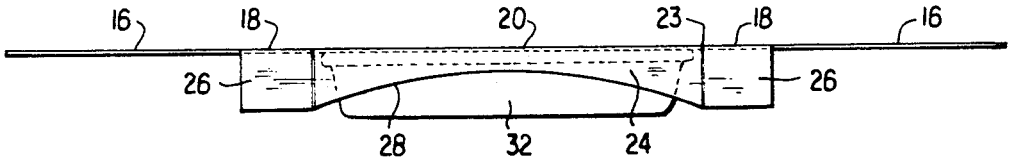
FIG. 3 is a view taken 90 degrees with respect to FIG. 2.

Referring now to FIG. 2 of the drawings, the initial step in the formation of the package is placing a flanged tray 32 beneath panel 20 and bending panels 24 and 26 down from their original plane approximately 110 degrees, so that the angle between these panels 24, 26 (shown at FIG. 2) and top panel 20 is approximately 70 degrees. FIG. 3 illustrates the partially formed package of FIG. 2, but rotated at an angle of 90 degrees with respect to the view of FIG. 2. Thus, at FIG. 3, one sees the folded down panels 24, 26 from their sides after they have been bent as indicated at FIG. 2.

Figure 4:
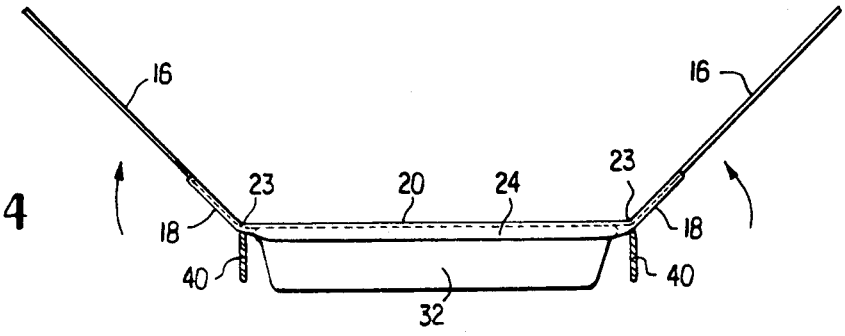
FIG. 4 is a view similar to FIG. 3, illustrating a later step in the formation of the package.

Referring now to FIG. 4, left and right panel pairs 16, 18 are bent upwardly, in the direction of the curved arrows, about respective fold lines 23. At this time, a pair of ploughs or swords 40, having upper straight edges, are placed beneath the blank, each directly under a respective fold line 23. FIG. 5 illustrates what is shown at FIG. 4, but looking 90 degrees with respect to FIG. 4. One of the swords 40 is illustrated in dashed lines, the dashed lines being used instead of solid lines to permit visualization of the now fully bent flaps 24.

Referring now to FIG. 6, with swords 40 still beneath fold lines 23, panels 16, 18 are rotated from their dashed line positions, in the direction of the curved arrows, so as to be folded beneath the flanged tray. At this time, the overlapping free ends 17 of panels 16 are glued together or fastened by any other means. After this gluing operation, swords 40 are removed and the completed package is ready for shipment or storage.

FIG. 7 further illustrates the locking or latching action of flaps 24, with the curved edge 28 of each corresponding to the radius of curvature of flange 34 and tray 32 where contact between the tray and flaps 24 is made. Tray flange 34 is shown as relatively thick, but it will be readily seen that its thickness and its radial extent are both optional variables.

The latching action of this invention stems from the fact that with panels 24, 26 folded to the position indicated at FIGS. 2 and 3, subsequent upward bending of panels 16, 18 about fold lines 23 will cause flaps 24 to automatically rotate about fold lines 23 towards the plane of panel 20, from the position indicated at FIGS. 2 and 3. Bending of tabs 26 about lines 23 accompanies bending of panels 16, 18. Tabs 26 arrive in surface contact with side panels 18. This movement, when completed, results in the configurations shown at FIGS. 4 and 5. Swords 40 should be in contact with respective fold lines 23 prior to and during the folding down shown by the curved arrows of FIG. 6, to overcome the resilient tendancy of the flaps to rotate back.

It will further be observed that the resultant open ended rectangular tube defined by the folded wrapper is reinforced by the two tab panels 26 at each open end. This yields additional stacking strength for the package. This double thickness at each of the four corners of the open tube wrapper is seen at FIGS. 6 and 7.

Figure 8:
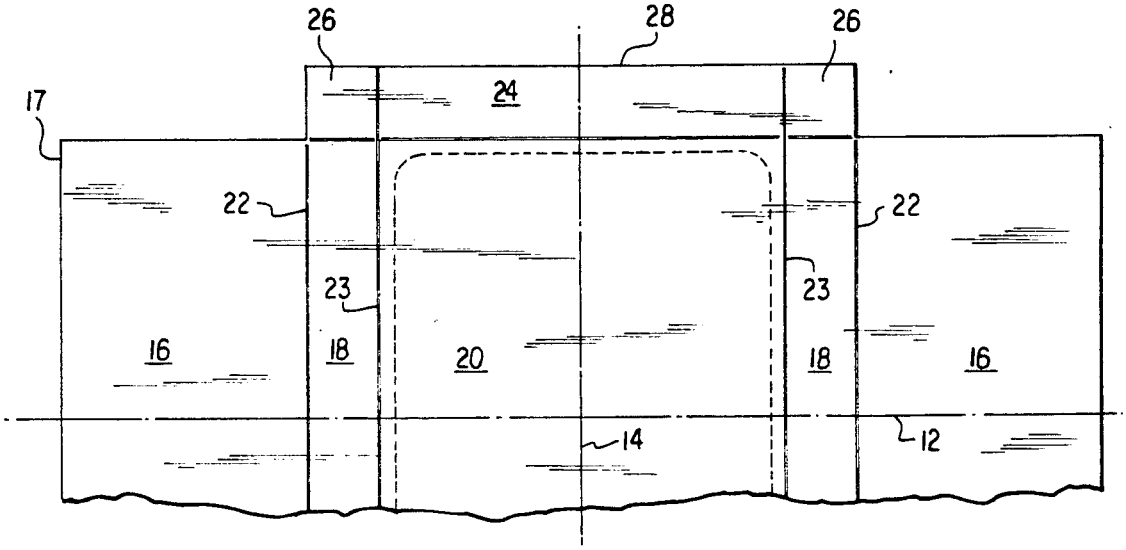
FIG. 8 is a partial plan view, similar to FIG. 1, illustrating a blank for a rectangular flanged tray, and also illustrates in phantom the outline of a rectangular tray.

The invention is also useful in packaging flanged trays which are rectangular. FIG. 8 illustrates a portion of a blank for such a tray. Instead of being concavely curving, the free edge of flap 24 is straight, this straight free edge also denoted as 28. The outline of a portion of a rectangular flanged tray is indicated in phantom in FIG. 8. The same steps described above are used in forming a package with the blank of FIG. 8.

Figure 9:
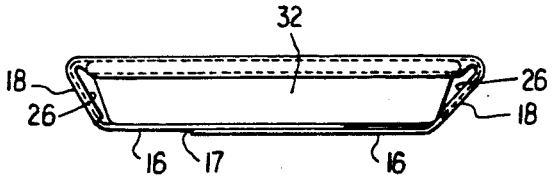
FIG. 9 is an end elevational view of the package of this invention having a trapezoidal transverse cross section.

FIG. 9 is a view similar to FIG. 6, except that the ends 17 of panels 16 have been overlapped more, or else panels 16 are of a lesser longitudinal length than shown in FIG. 1 and 8, so as to form a package trapezoidal in transverse cross section. Such a trapezoidal wrapper can be used whenever it is desired to match the slope of side walls 18 with the side taper of a tray 32.

Figure 10:
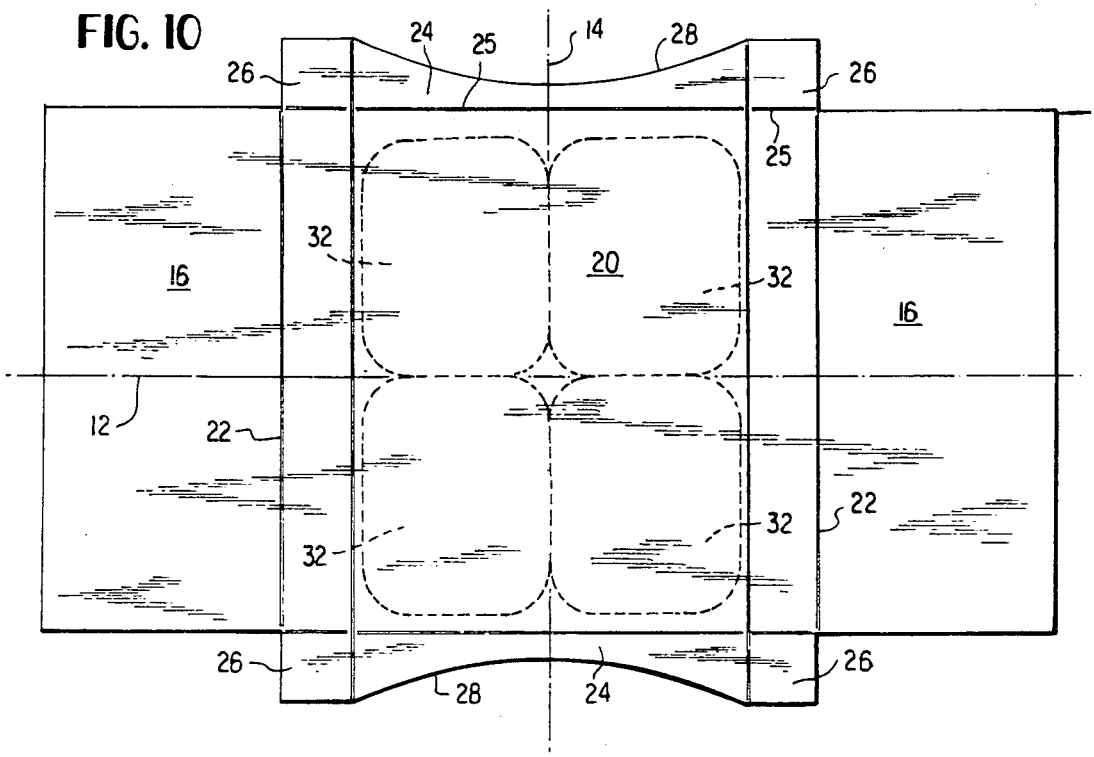
FIG. 10 is a plan view of a unitary blank of paperboard, illustrating in phantom the outline of a plurality of flanged trays.
Figure 11:
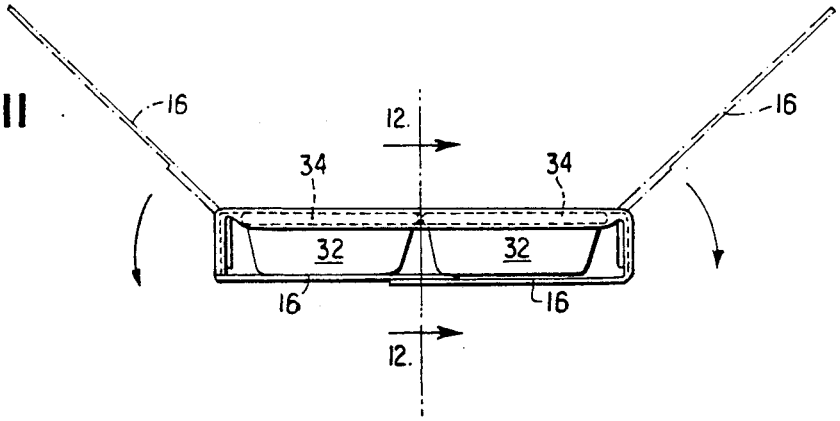
FIG. 11 is a view similar to FIG. 6 and illustrates one step in the formation of the package of this invention wherein four flanged trays are enclosed by the wrapper.
Figure 12:
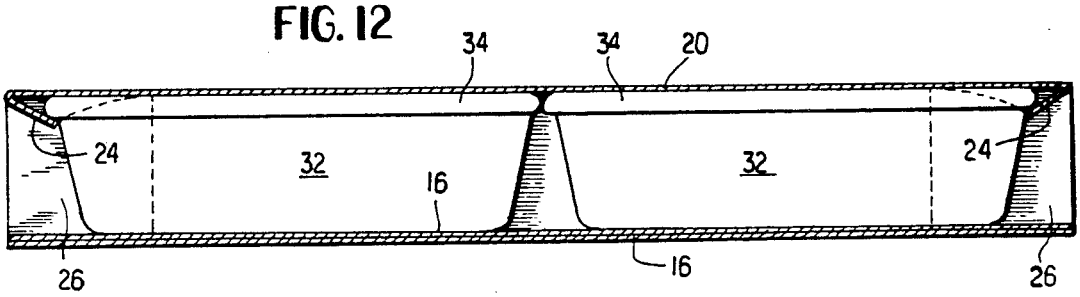
FIG. 12 is a view taken along section 12—12 of FIG. 11 and illustrates the completed package of four flanged trays.

FIGS. 10 and 11 illustrate the wrapper of this invention as wrapped around four flanged trays to form a four tray package. The blank of FIG. 10 is of the same form and construction as that of FIG. 1, with four flanged trays 32 to be wrapped as indicated in dashed or phantom lines. FIG. 11 is a view similar to FIG. 6, except that four trays, indicated at FIG. 1, instead of a single tray are enclosed by the wrapper. The same steps as those illustrated at FIGS. 2 to 5 are employed to reach the package forming step shown at FIG. 11. FIG. 12, similar to FIG. 7, shows the completed four tray package. It is seen that the tray flanges at the open ends of the wrapper tube are engaged in the same manner as the opposite sides of the flange of the single wrapper of FIG. 7. Except for the number of trays enclosed, the wrapper construction and formation are the same as that of FIGS. 1 to 7.

While not illustrated, it will be apparent that the construction shown at FIGS. 8 and 9 may also be used with plural flanged trays as well.

The plural trays may also be positioned along a single axis such as indicated by 14 at FIGS. 1 and 10, as for example a single row of two or three flanged trays. In the case of a simple row having three or more trays therein, only those trays at the open ends of the wrapper tube are contacted by a respective flange 24. The same is true in the case of six flanged trays arranged in two parallel rows of three trays in each row. Namely, the middle trays of each such row are not contacted by either of the two flanges 24.

We claim:

1. A package including a flanged tray and a wrapper snugly surrounding the tray, the wrapper formed of a unitary paperboard blank folded to the form of a tube having open ends, the tube having top, bottom, and side walls, the top wall having a respective flap at each respective open end of the tube, each flap having two ends, each flap foldably joined to a respective end of the top wall, each flap having a free edge engaging respective lower, opposite portions of the flange of said flanged tray, and also engaging opposite portions of the tray, the flaps forming an angle of less than 90 degrees with said top wall, each end of each flap foldably joined to a respective tab, each tab extending at least partially from the top wall to the bottom wall, opposite ends of the blank joined to form said bottom wall, whereby movement of the tray from either open end of the wrapper is prevented.

2. The package of claim 1 wherein said tabs are in surface contact with the interior of the side walls.

3. The package of claim 1 wherein the wrapper is rectangular in transverse cross section.

4. The package of claim 1 wherein the wrapper is trapezoidal in transverse cross section.

5. The package of claim 1 wherein the free edges of the flaps are each curved in their respective contacts with the flange of the flanged tray, and wherein the tray is similarly curved at these contacts.

6. The package of claim 1 wherein the free edges of the flaps are each straight in their respective contacts with the flange of the flanged tray, and wherein the tray is also straight at these contacts.

7. A package including a plurality of flanged trays and a wrapper snugly surrounding the trays, the wrapper formed of a unitary paperboard blank folded to the form of a tube having open ends, the tube having top, bottom, and side walls, the top wall having a respective flap at each respective open end of the tube, each flap having two ends, each flap foldably joined to a respective end of the top wall, each flap having a free edge engaging a respective lower portion of the flange of a respective flanged tray located at a respective open end of said tube, the flaps forming an angle of less than 90 degrees with said top wall, each end of each flap foldably joined to a respective tab, each tab extending at least partially from the top wall to the bottom wall, opposite ends of the blank joined to form said bottom wall, whereby movement of the tray from either open end of the wrapper is prevented.

8. The package of claim 7 wherein said tabs are in surface contact with the interior of the side walls.

9. The package of claim 7 wherein the wrapper is rectangular in transverse cross section.

10. The package of claim 7 wherein the wrapper is trapezoidal in transverse cross section.

11. The package of claim 7 wherein the free edges of the flaps are each curved in their respective contacts with the flanges of respective flanged trays, and wherein respective trays are similarly curved at these contacts.

12. The package of claim 7 wherein the free edges of the flaps are each straight in their respective contacts with the flanges of respective flanged trays, and wherein respective trays are also straight at these contacts.

* * * * *